US005370353A

United States Patent [19]

Billson

[11] Patent Number: 5,370,353

[45] Date of Patent: Dec. 6, 1994

[54] MOULDS FOR PLASTER PIECES

[75] Inventor: Robert T. Billson, Sheffield, England

[73] Assignee: Aristo-Mould Limited, Chesterfield, England

[21] Appl. No.: 103,088

[22] Filed: Aug. 6, 1993

[30] Foreign Application Priority Data

Jul. 23, 1993 [GB] United Kingdom ..... 9315280.9

[51] Int. Cl.[5] ..... B28B 7/00; B65D 81/36

[52] U.S. Cl. ..... 249/120; 206/575; 249/117; 249/127; 249/134; 249/139

[58] Field of Search ..... 206/223, 575; 249/117, 249/119, 120, 127, 133, 139, 134

[56] References Cited

U.S. PATENT DOCUMENTS

| | | | |
|---|---|---|---|
| 3,384,220 | 5/1968 | Linstead | 206/575 |
| 3,840,113 | 10/1974 | Bartleson | 206/575 |
| 3,921,801 | 11/1975 | Sway | 206/223 |
| 3,989,220 | 11/1976 | Greenberg | 249/139 |
| 4,129,213 | 12/1978 | Fleig | 206/575 |
| 4,215,843 | 8/1980 | Gay et al. | 249/117 |
| 4,767,009 | 8/1988 | Hornecker et al. | 206/575 |
| 5,088,598 | 2/1992 | Iguchi | 206/575 |

*Primary Examiner*—James P. Mackey

*Attorney, Agent, or Firm*—Trexler, Bushnell, Giangiorgi & Blackstone

[57] ABSTRACT

A mould assembly for the manufacture of at least one plaster piece includes at least two parts, one being a support member (21) and the other being a mould member (22), the support member being formed of lightweight rigid material with a lower base surface (23) and at least one upwardly open cavity (24), and the mould member being formed of "rigid" film material having at least one depression (26) to depend into the cavity from at least one integral planar flange portion (27) parallel to the base surface of the support member, the inside (28) of the depression being impressed with mould detail for the plaster piece, and space (29) being afforded between the base surface (23) of the support member (21) and the flange portion (27) of the mould member (22) for accommodating at least dry plaster material for use in moulding the plaster piece.

17 Claims, 5 Drawing Sheets

MOULDS FOR PLASTER PIECES

BACKGROUND OF THE INVENTION

This invention relates to moulds for the manufacture of plaster pieces, such as architectural details for decorative purposes.

One object of the invention is to provide moulds for the manufacture of plaster pieces suitable for the DIY market together with materials for use in moulding the plaster pieces in convenient form.

Another object is to provide with the moulds and materials equipment for fixing the moulded plaster pieces in place.

SUMMARY OF THE INVENTION

According to the present invention, mould means for the manufacture of at least one plaster piece comprises at least two parts, one being a support member and the other being a mould member, the support member being formed of lightweight rigid material with a lower base surface and at least one upwardly open cavity, and the mould member being formed of "rigid" film material having at least one depression to depend into the cavity from at least one integral planar flange portion parallel to the base surface of the support member, the inside of the depression being impressed with mould detail for the plaster piece, and space being afforded between the base surface of the support member and the flange portion of the mould member for accommodating at least dry plaster material for use in moulding the plaster piece.

In use, the support member holds the depression of the mould member to shape while the mould detail is filled with plaster mix and while the latter sets, then the mould member with the at least one formed plaster piece can be lifted from the support member and the mould member stripped from the set plaster piece.

By the expression "rigid" film material is meant a non-elastic material, such as "rigid" PVC or high-impact polystyrene, having a thickness of such relative thinness, e.g., of the order of 100 to 300 microns, that it depends upon the support member for maintenance of the shape of the depression during and after pouring of plaster mix, yet allowing of slight flexing of the mould member for peeling of its depression from the set plaster piece.

The depression of the mould member can be impressed with the accurate mould detail for the plaster piece by means of a master press tool, e.g., of aluminium, contoured to the precise shape and detail required; however, the cavity of the support member does not need to conform closely to the contour of the outside of the depression of the mould member in order to provide adequate support.

The support member may be in the form of a block of foamed polystyrene with parallel upper and lower surfaces, at least one cavity in its upper surface receiving the depression of the mould member and at least one cavity in its lower surface for accommodating the dry plaster material for use in moulding the plaster piece; the cavity in the upper surface may have a rectangular vertical cross-section, with the lowermost part of the depression of the mould member resting on the bottom of the cavity, which bottom may have portions at different levels on which rest portions of the depression of the mould member having corresponding depths.

The lower surface of the support block may also be provided with cavities for accommodating reinforcement elements for incorporation in the plaster piece and/or equipment for use during forming of the plaster piece and/or for fixing the moulded plaster piece in place; and the complete mould means may be packaged in a cardboard box.

Alternatively, the support member may be formed by a cardboard tray, with a bottom panel providing the base surface and with upstanding side panels and end panels, in which case the mould member may have side panels and end panels depending from the flange portion and fitting closely alongside the side and end panels of the support member. The inner face of the bottom panel of the support member may form the bottom of the cavity and upon which the lowermost part of the depression of the mould member rests, or the bottom of the cavity in the support member may be foraged by a block secured to the inner face of the bottom panel of the cardboard tray, and the block secured to the inner face of the bottom panel of the base part may be formed of resilient material.

The space between the bottom panel of the cardboard tray and the flange portion of the mould men, her, which space is available for accommodating dry plaster material for use in moulding the plaster piece, is preferably adequate for accommodating also reinforcement elements for incorporation in the plaster piece and/or equipment for use during forming of the plaster piece and/or for fixing the moulded plaster piece in place. Conveniently, the depending side and end panels of the mould member fit inside the upstanding side and end panels of the support member, and a lid is also provided having a cover panel overlying the "rigid" film mould member and having depending side and end panels fitting outside the upstanding side and end panels of the support member.

Again, the support member may be formed by a two-part cardboard box, one being a base part with a bottom panel providing the base surface and upstanding side panels and end panels, and the other being an upper part with a top panel having depending side panels and end panels to fit closely alongside the side and end panels of the base part, the top panel also having at least one opening into which the depression of the mould member fits, and the at least one flange portion of the mould member resting on the top panel alongside the opening. The inner face of the bottom panel of the base part of the two-part cardboard box may form the bottom of the cavity and upon which the lowermost part of the depression of the mould member rests, or the bottom of the cavity in the support member may be formed by a block secured to the inner face of the bottom panel of the base part of the two-part cardboard box, and the block secured to the inner face of the bottom panel of the base part of the two-part cardboard box may be formed of resilient material.

Likewise, the space between the bottom panel of the base part of the two-part cardboard box and the top panel of the upper part, which space is available for accommodating dry plaster material for use in moulding the plaster piece, is preferably adequate for accommodating also reinforcement elements for incorporation in and/or equipment for use during forming of the plaster piece and/or for fixing the moulded plaster piece in place. Again the depending side and end panels of the upper part of the two-part cardboard box fit conveniently inside the upstanding side and end panels of the base part, and a lid is also provided having a cover panel overlying the "rigid" film mould member and having depending side and end panels fitting outside the upstanding side and end panels of the base part of the box.

As previously mentioned, the mould member may be formed of "rigid" PVC or of a high-impact polystyrene. A mould member for a ceiling centre or other plaque may be formed of high-impact polystyrene film having an initial thickness of 100 to 200 microns, while a mould member for a niche surround or fire surround may be formed of high-impact polystyrene film having an initial thickness of about 300 microns.

Mould means according to any of the above described embodiments may provide for the manufacture of more than one plaster piece; thus cavities and depressions for use in manufacturing ceiling centres or other plaques may be provided in the space within the confines of a cavity and depression for use in manufacturing a niche surround, a fire surround or a picture or mirror frame.

BRIEF DESCRIPTION OF THE DRAWINGS

Embodiments of the invention and manner of use thereof will now be described, by way of example only, with reference to the accompanying drawings in which.

DESCRIPTION OF THE ILLUSTRATED EMBODIMENTS

Figure 1:
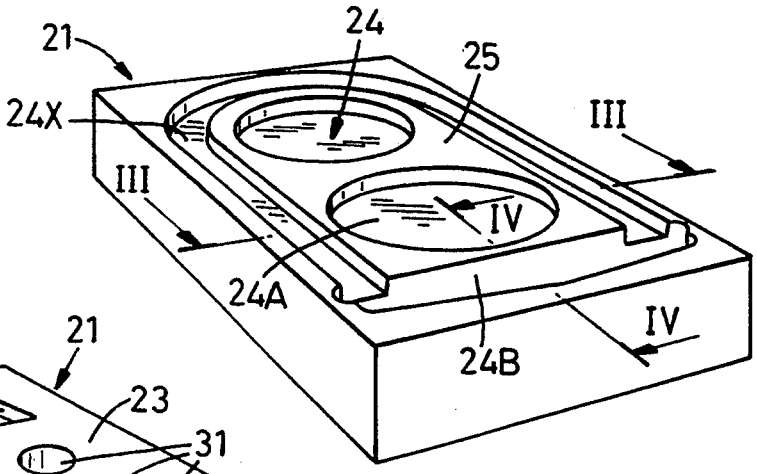
FIG. 1 is a perspective view of a support member in the form of a block, being one part of mould means in accordance with the invention.

Referring to FIGS. 1 to 5, mould means for the manufacture of plaster pieces, such as architectural details for decorative purpose, and suitable for the DIY market, comprises at least two parts, one being a support member 21 and the other being a mould member 22, the support member being formed of lightweight rigid material such as a formed polystyrene block, with a lower base surface 23 and at least one upwardly open cavity 24 formed in an upper surface 25 parallel to the lower surface, and the mould member being formed of "rigid" film material, such as "rigid" PVC or high-impact polystyrene, having at least one depression 26 to depend into the cavity 24 from at least one integral planar flange portion 27 parallel to the base surface 23 of the support member 21 (see FIG. 3), the inside 28 of the depression 26 being impressed with mould detail for the plaster piece, and space 29 being afforded, by at least one cavity 30 in the base surface of the support member or block, between that base surface and the flange portion 27 of the mould member for accommodating at least dry plaster material (not shown) for use in moulding the plaster piece.

Figure 3:
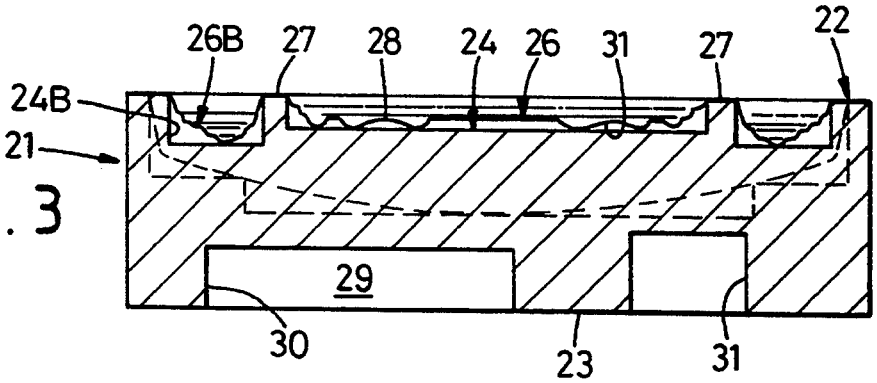
FIG. 3 is an enlarged vertical cross-section through the block of FIGS. 1 and 2 taken from the line III—III in FIG. 1 and with the other part of the mould means, a "rigid" film mould member, in place.
Figure 4:
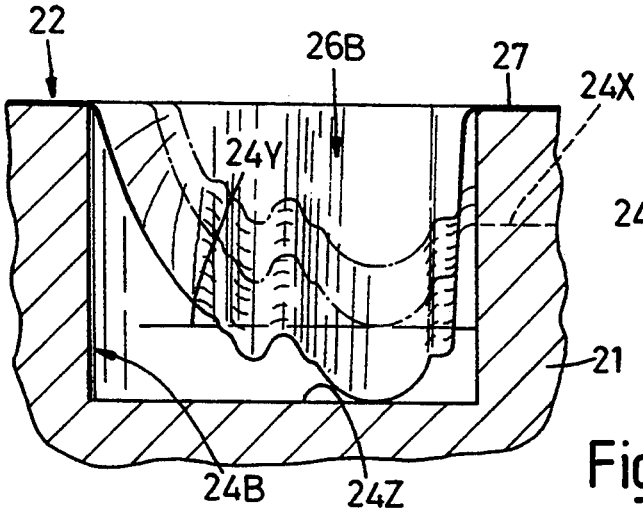
FIG. 4 is a further enlarged fragmentary vertical section taken from the line IV—IV in FIG. 1.
Figure 5:
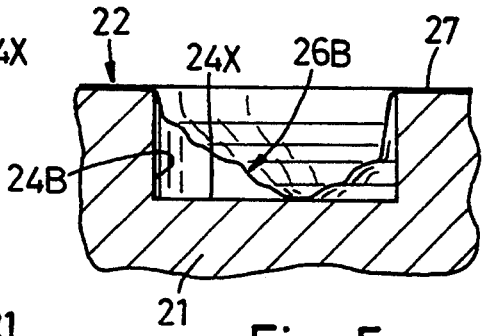
FIG. 5 is a fragmentary vertical section corresponding to the top left hand corner of FIG. 3 but to the same scale as FIG. 4.

The thickness of the film 22, which because of its comparative thinness is shown in section in FIGS. 3 to 5 by a solid line, the thickness of which is exaggerated at least along the flange portion, is of the order of 100 to 300 microns, and it depends upon the support member 22 for maintenance of the shape of the depression 26 during and after pouring of plaster mix into it. However, the cavity 24 in the support member or block does not need to conform closely to the contour of the outside 31 of the depression 26 in order to provide adequate support. Thus, the cavity 24 will be seen to have a rectangular vertical cross-section, with the lowermost part of the depression resting on the bottom of the cavity (see FIG. 3).

FIGS. 1 and 3 show how the mould means 21, 22 may provide for the manufacture of more than one plaster piece; thus the cavity 24 (and depression 26) for use in manufacturing a ceiling centre (or other plaque) has adjacent to it a similar cavity 24A (for cooperation with a similar depression which is not shown), both being provided in the space within the confines of a cavity 24B (and its corresponding depression 26B) for use in manufacturing a niche surround, and where, as shown in FIG. 4, the depression 26B has portions at different depths, the bottom of the cavity 24B can have portions 24X, 24Y, 24Z at different levels on which those portions of the depressions rest.

Figure 2:
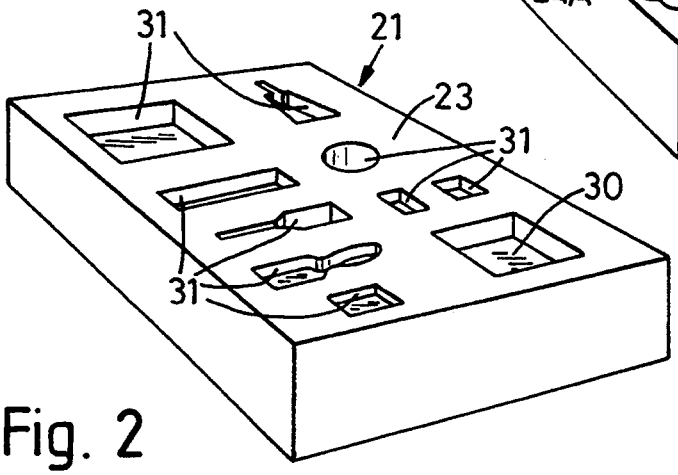
FIG. 2 is a perspective view of the block of FIG. 1 after inversion.

The lower surface 23 of the support block 21 is shown in FIGS. 2 and 3 as being provided with cavities 31 for accommodating reinforcement elements (not shown) for incorporation in the plaster piece or pieces (particularly the niche) and/or equipment for use during forming of the plaster piece or pieces (such as a spirit level, spatula or scoring tool—none of these being shown in place) and/or for fixing the moulded piece or pieces in place (such as screws and a screwdriver—neither being shown); and the complete mould means may be packaged in a cardboard box (not shown).

Figure 6:
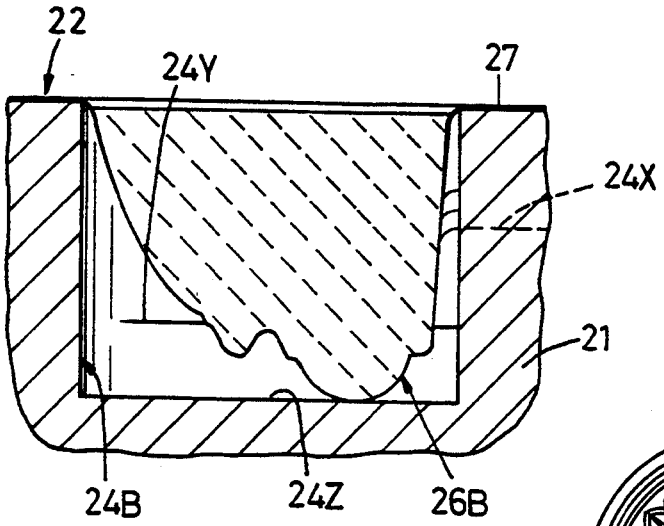
FIGS. 6 and 7 correspond to FIGS. 4 and 5 but show these mould portions filled with plaster.
Figure 7:
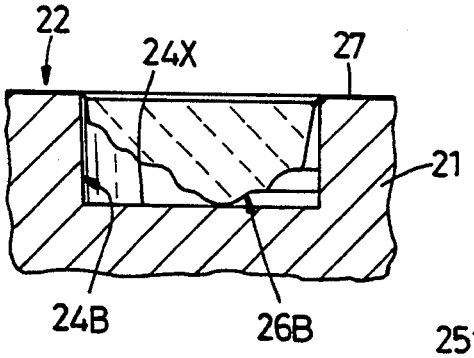

FIGS. 6 and 7, corresponding to FIGS. 4 and 5, are shown with the depression 26B filled with plaster mix, but FIGS. 8 to 12 inclusive will now be referred to in describing the manner of use of mould means in accordance with the invention to manufacture a plaster piece, which in this case is a ceiling centre. The mould member 22 having the depression 26, in which the ceiling centre will be moulded, is shown with its own flange portion 27 separate from that of an adjacent depression (such as the depression 26B shown in FIGS. 3 to 5 seated in the cavity 24B in the block 21), as proves convenient for handling, especially of the set plaster pieces and during stripping of the mould members therefrom.

Figure 8:
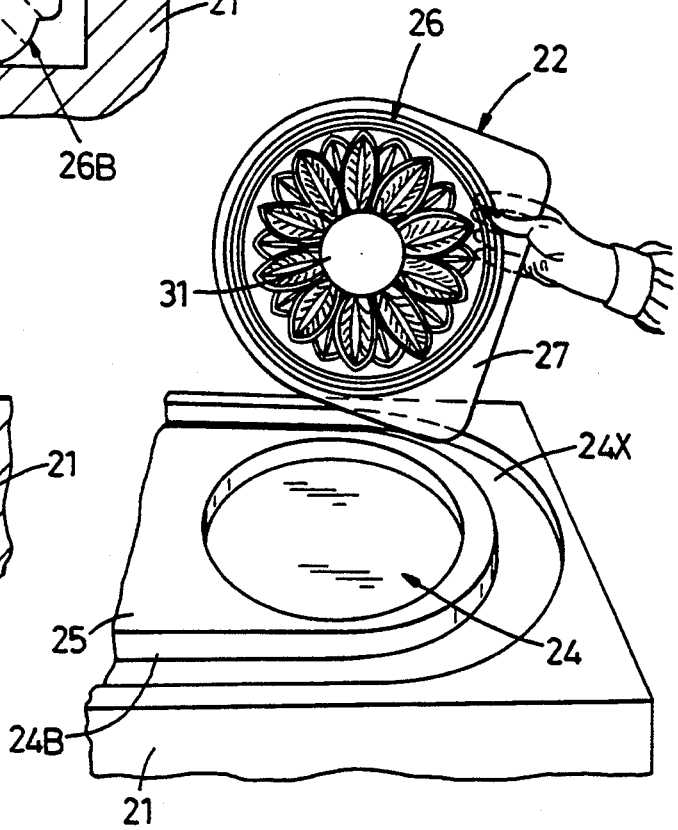
FIG. 8 is a fragmentary perspective view showing a mould member for a ceiling centre about to be placed on a corresponding part of the support member seen in FIG. 1.
Figure 9:
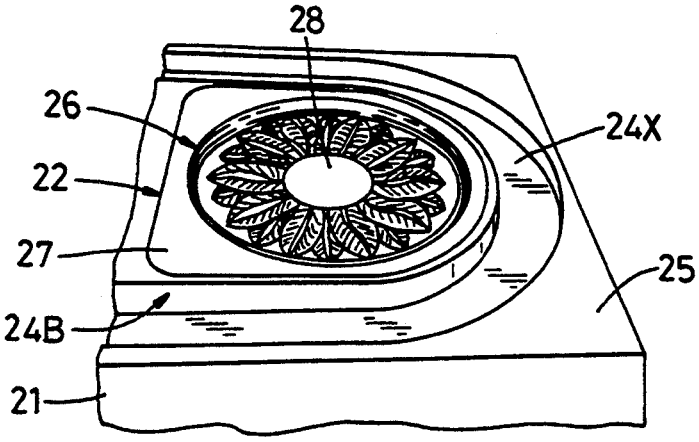
FIG. 9 corresponds to FIG. 8 but shows the mould member in place on the support member.
Figure 10:
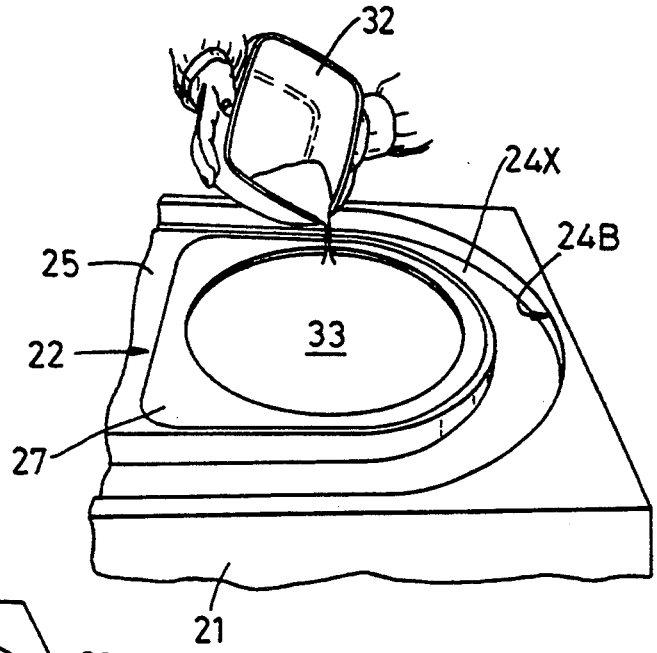
FIG. 10 corresponds to FIG. 9 but shows plaster mix being poured into the depression of the mould member.

The support member or block 21 is conveniently placed on its lower surface 23 on a level worktable (checked for level by using a spirit level, e.g., housed in one of the cavities 31) so that its upper surface 25 and the flange portion 27 of the mould member 22 will be level when the latter is placed on the block 21 with its depression 26 seated in the cavity 24 (see FIGS. 8 and 9).

A measured quantity of dry plaster material (e.g., a pre-weighed pack housed in the cavity 30) is mixed with an indicated volume of water in a suitable vessel 32 and poured into the depression 26 (FIG. 10) to fill it almost to the level of the flange portion 27.

Figure 11:
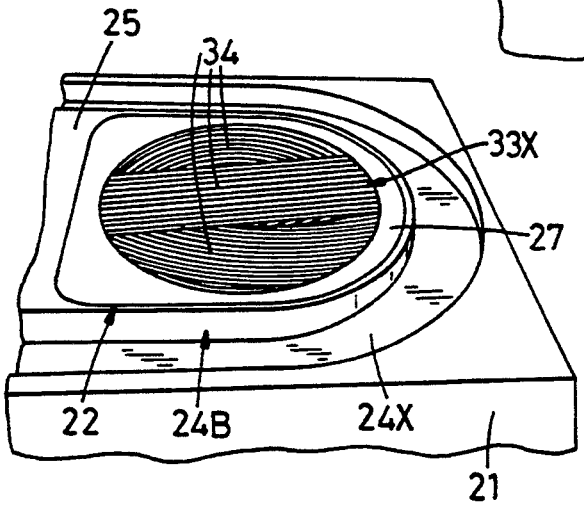
FIG. 11 corresponds to FIG. 10 but shows the set plaster after scoring to assist adhesion of cement for securing the finished plaster piece in place.

When the plaster mix 33 has set, but while it is still "green", it may be scored, as indicated at 34 in FIG. 11 (e.g., by means of an appropriate tool housed in one of the cavities 31).

Figure 12:
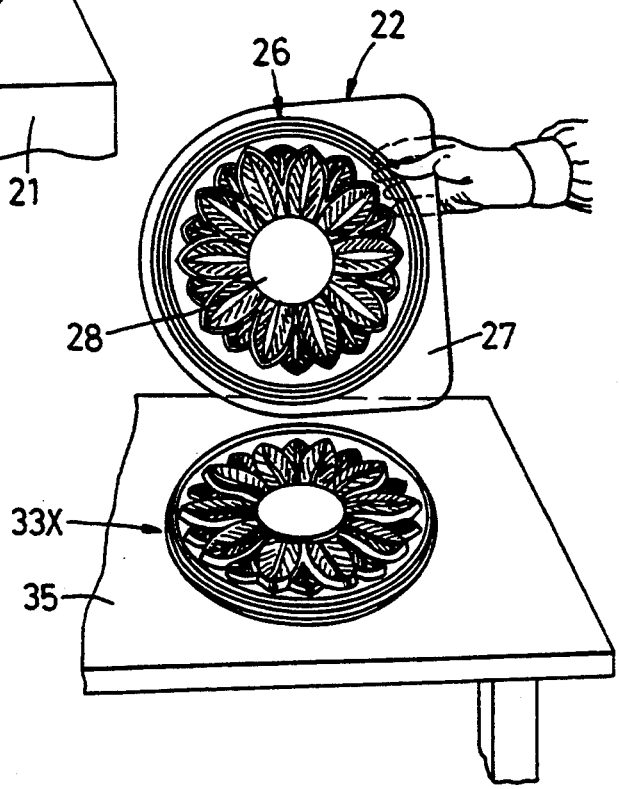
FIG. 12 is a fragmentary perspective view showing the mould member being lifted away from the finished plaster piece resting on a table.

The set plaster piece 33X can then be inverted along with the mould member 22 on to the worktable 35, shown in FIG. 12, and finally the mould member stripped from the plaster piece, which—subsequently—after thorough drying can be fixed in place, as by means of screws and a screwdriver and/or adhesive or sealant (e.g., housed in other of the cavities 31 in the lower Surface 23 of the support member or block 21).

The same mould member 22 can be used again to manufacture another ceiling centre in the same manner as described above, but due to the thinness of the film material, especially where drawn down into the depression 26, and heat generated in the plaster mix, repeated use is limited to a handful of pieces before the depression destructs.

Figure 13:
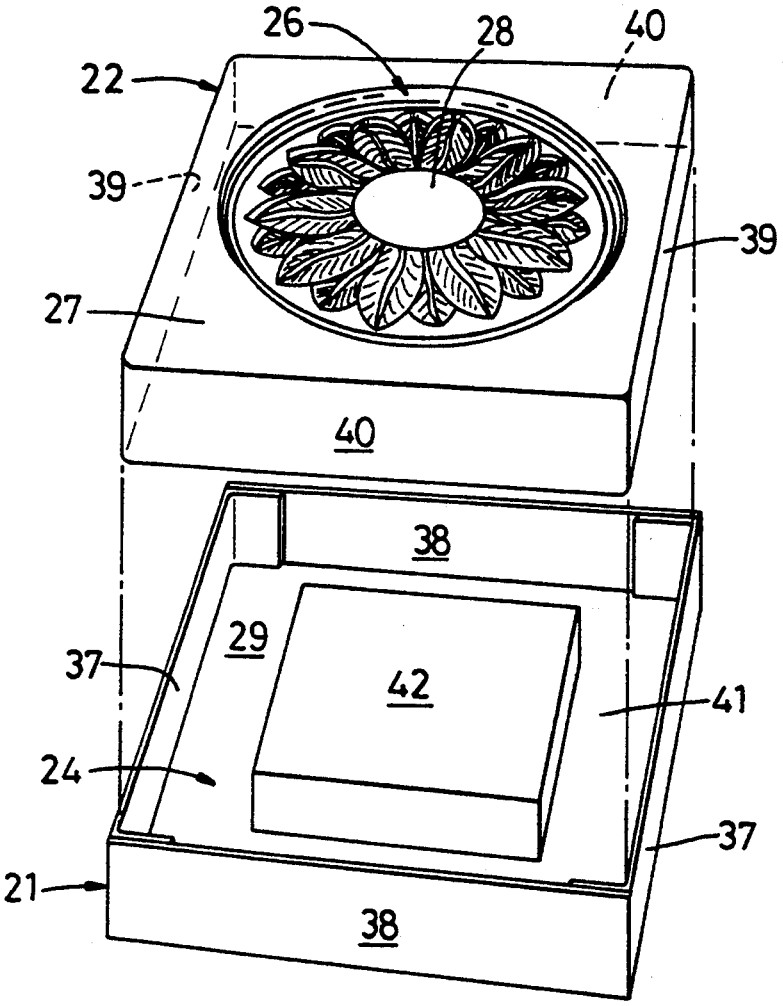
FIG. 13 is an exploded perspective view of another construction of mould means in accordance with the invention.
Figure 14:
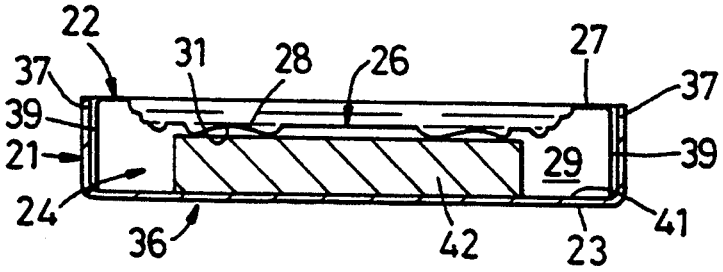
FIG. 14 is a vertical cross-section through the assembled mould means of FIG. 13.
Figure 15:
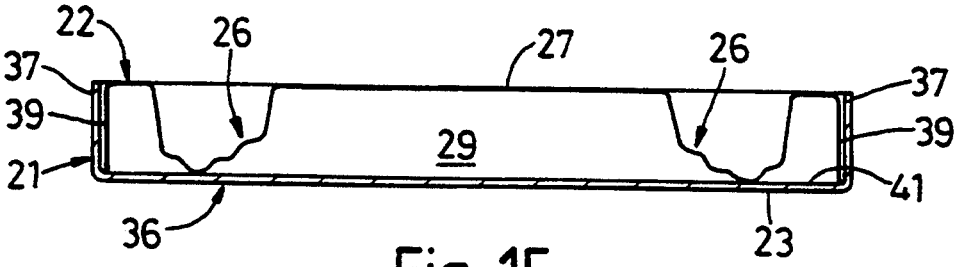
FIG. 15 is a vertical cross-section through a modified form of the mould means of FIGS. 13 and 14.

In the embodiment of mould means shown in FIGS. 13 and 14, the support member 21 is formed by a cardboard tray, with a bottom panel 36 providing the base surface 23 and with upstanding side panels 37 and end panels 38, and the mould member 22 has side panels 39 and end panels 40 depending from the flange portion 27 and fitting closely alongside and inside the side and end panels of the support member. The inner face 41 of the bottom panel 36 of the support member 21 may form the bottom of the cavity 24 and upon which the lowermost part of the depression 26 of the mould member 21 rests, as shown in the modification illustrated by FIG. 15, or the bottom of the cavity may be effectively formed by a block 42 secured to the inner face 41, as shown in FIGS. 13 and 14, and the block 42 may be formed of resilient material.

The space 29 between the bottom panel 36 of the cardboard tray 21 and the flange portion 27 of the mould member 22, which space is available for accommodating dry plaster material, is preferably adequate for accommodating also reinforcing elements and/or equipment for use during moulding of the plaster piece and/or for fixing in place, none of which is shown.

A lid (not shown) may be provided having a cover panel overlying the depression 26 and flange portion 27 of the mould member 22 and having depending side and end panels fitting outside the side and end panels 37, 38 of the cardboard tray support member 21.

Figure 16:
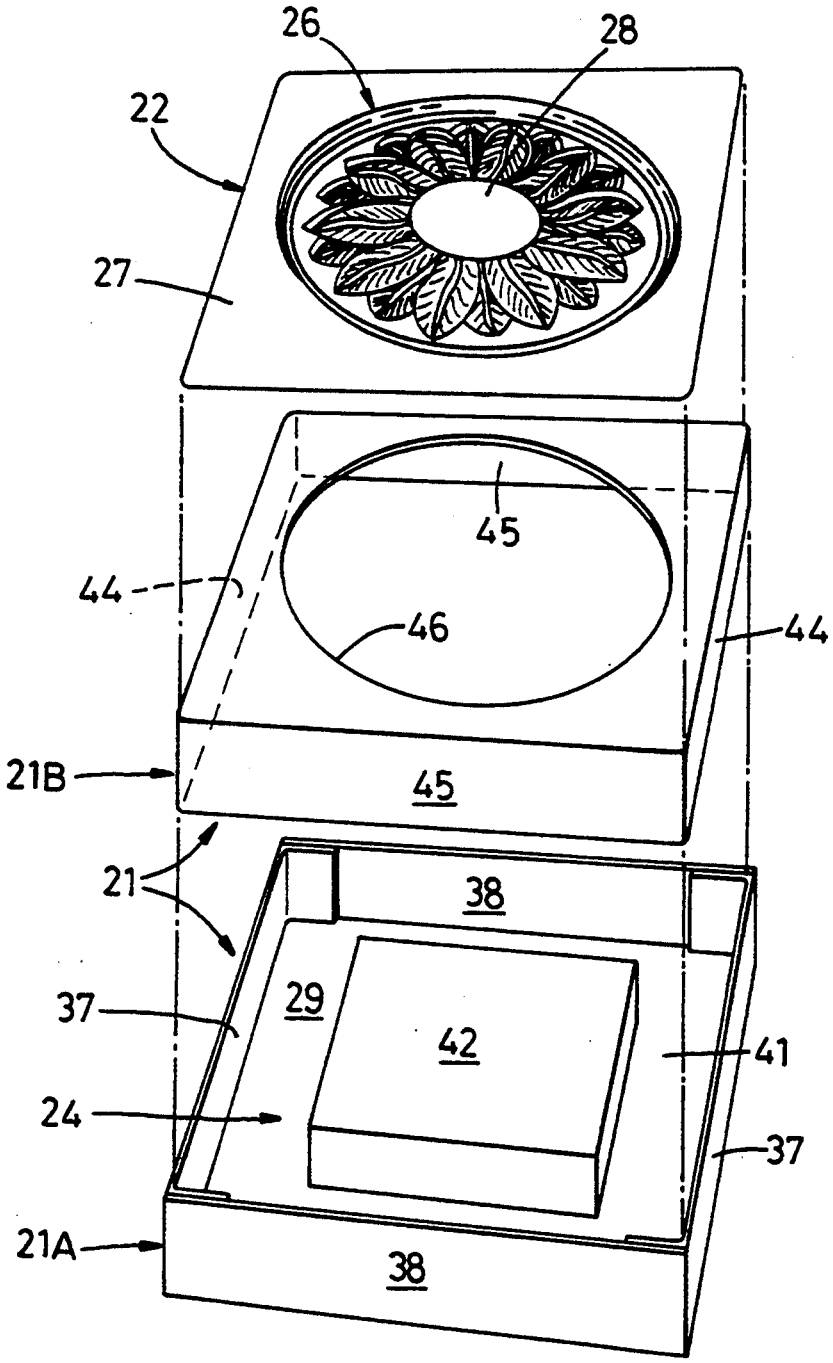
FIGS. 16 and 17 correspond to FIGS. 13 and 14 but show a further construction of mould means in accordance with the invention.
Figure 17:
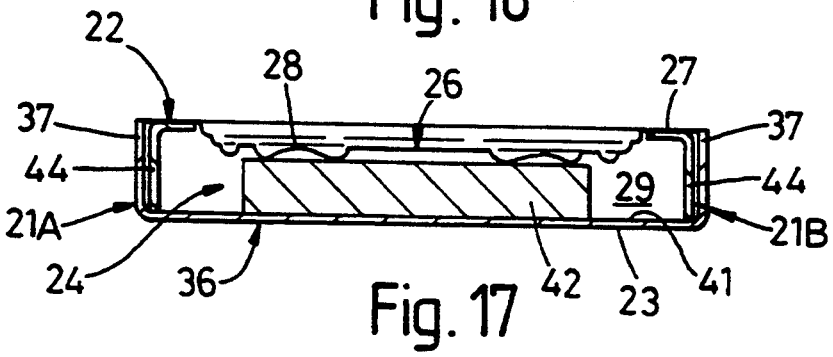

In the embodiment of mould means shown in FIGS. 16 and 17, the support member 21 is formed by a two-part cardboard box, one being a base part 21A similar to the tray in FIGS. 13 and 14, complete with block 42, and the other being an upper part 21B with a top panel 43 having depending side panels 44 and end panels 45 to fit closely alongside and inside the side and end panels 37, 38 of the tray-like base part 21A, the top panel 43 also having an opening 46 into which the depression 26 of the mould member 22 fits, and the flange portion 27 of the mould member resting on the top panel alongside and around the opening.

The space 29 between the bottom panel 36 of the base part 21A of the box and the top panel of the upper part 21B, which space is available for accommodating dry plaster material, is again adequate for accommodating also reinforcing elements, etc., as in the previous embodiments.

Again, a lid (not shown) may be provided.

It will be appreciated that in FIGS. 13 to 17 the thickness of the cardboard of the tray and box respectively have been exaggerated to clearly distinguish them from the film material of the mould members.

What I claim is:

1. Mould means for the manufacture of at least one plaster piece, the mould means comprising at least two parts, one being a support member and the other being a mould member, the support member being formed of rigid material with a lower base surface and at least one upwardly open cavity, and the mould member being formed of rigid film material having at least one depression to depend into the cavity from at least one integral planar flange portion parallel to the base surface of the support member, with a lowermost part of the depression of the mould member resting on a bottom of the cavity, the inside of the depression being impressed with mould detail for the plaster piece, and space being afforded between the base surface of the support member and the flange portion of the mould member for accommodating at least dry plaster material for use in moulding the plaster piece, wherein the support member is in the form of a block of foamed polystyrene with parallel upper surface and said lower base surface, said cavity formed below said upper surface receiving the depression of the mould member.

2. Mould means in claim 1, wherein the cavity has a rectangular vertical cross-section.

3. Mould means as in claim 2, wherein the bottom of the cavity of the support member has portions at different levels on which rest portions of the depression of the mould member having corresponding depths.

4. Mould means as in claim 1, wherein the lower surface of the support member is also provided with base storage recesses for accommodating reinforcement elements for incorporation in the plaster piece or equipment for use during forming of the plaster piece or fixing the moulded plaster piece in place.

5. Mould means for the manufacture of at least one plaster piece, the mould means comprising at least two parts, one being a support member and the other being a mould member, the support member being formed of rigid material with a lower base surface and at least one upwardly open cavity, and the mould member being formed of rigid film material having at least one depression to depend into the cavity from at least one integral planar flange portion parallel to the base surface of the support member, with a lowermost part of the depression of the mould member resting on a bottom of the cavity, the inside of the depression being impressed with mould detail for the plaster piece, and space being afforded between the base surface of the support member and the flange portion of the mould member for accommodating at least dry plaster material for use in moulding the plaster piece, wherein the support member is formed by a cardboard tray, with a bottom panel providing the base surface and with upstanding side panels and end panels, and wherein the mould member has side panels and end panels depending from the flange portion and fitting closely alongside the side and end panels of the support member, and wherein the bottom of the cavity in the support member upon which the lowermost part of the depression of the mould member rests is formed by a block secured to an inner face of the bottom panel of the cardboard tray.

6. Mould means as in claim 5, wherein the block secured to the inner face of the bottom panel of the cardboard tray is formed of resilient material.

7. Mould means as in claim 5, wherein the depending side and end panels of the mould member fit inside the upstanding side and end panels of the support member, and a lid is also provided having a cover panel overlying the rigid film mould member and having depending side and end panels fitting outside the upstanding side and end panels of the support member.

8. Mould means for the manufacture of at least one plaster piece, the mould means comprising at least two parts, one being a support member and the other being a mould member, the support member being formed of rigid material with a lower base surface and at least one upwardly open cavity, and the mould member being formed of rigid film material having at least one depression to depend into the cavity from at least one integral planar flange portion parallel to the base surface of the support member, with a lowermost part of the depression of the mould member resting on a bottom of the cavity, the inside of the depression being impressed with mould detail for the plaster piece, and space being afforded between the base surface of the support member and the flange portion of the mould member for accommodating at least dry plaster material for use in moulding the plaster piece, wherein the support member is formed by a two-part cardboard box, one part being a base part with a bottom panel providing the lower base surface and upstanding side panels and end panels, and the other part being an upper part with a top panel having depending side panels and end panels to fit closely alongside the side and end panels of the base part, the top panel also having at least one opening into said cavity into which the depression of the mould member fits, and the at least one flange portion of the mould member resting on the top panel alongside the opening.

9. Mould means as in claim 8, wherein an inner face of the bottom panel of the base part of the two-part cardboard box forms a bottom of the cavity and upon which the lowermost part of the depression of the mould member rests.

10. Mould means as in claim 8, wherein the bottom of the cavity in the support member and upon which the lowermost part of the depression of the mould member rests is formed by a block secured to the inner face of the bottom panel of the base part of the two-part cardboard box.

11. Mould means as in claim 10, wherein the block secured to the inner face of the bottom panel of the base part of the two-part cardboard box is formed of resilient material.

12. Mould means as in claim 8, wherein the depending side and end panels of the upper part of the two-part cardboard box fit inside the upstanding side and end panels of the base part, and a lid is also provided having a cover panel overlying the rigid film mould member and having depending side and end panels fitting outside the upstanding side and end panels of the base part of the box.

13. Mould means as in claim 1 wherein the mould member is formed of rigid PVC.

14. Mould means as in claim 1 wherein the mould member is formed of polystyrene.

15. Mould means as in claim 14, wherein said mould member is shaped for a ceiling center or other plaque and formed from film having thickness of 100 to 200 microns.

16. Mould means as in claim 14, wherein said mould member is shaped for a niche surround or fire surround and formed from film having thickness of about 300 microns.

17. Mould means as in claim 1, comprising more than one said depression for the manufacture of more than one plaster piece.

* * * * *